US009050850B2

(12) United States Patent
Gillum et al.

(10) Patent No.: US 9,050,850 B2
(45) Date of Patent: Jun. 9, 2015

(54) MICRO MOTION POPPET VALVE ASSEMBLY FOR DELIVERY OF INK WITH LARGE PIGMENT PARTICLES TO A WRITING NIB AND WRITING INSTRUMENT COMPRISING SAME

(75) Inventors: Christoph Gillum, Middletown, OH (US); Christopher Matice, Bellbrook, OH (US); David Parrott, Cincinnati, OH (US); Anup Paul, Mason, OH (US); Haskell Simpkins, Cincinnati, OH (US); Robert G. Challman, Naperville, IL (US); James F. Yoder, Blanchester, OH (US)

(73) Assignee: SANFORD, L.P., Downers Grove, IL (US)

( * ) Notice: Subject to any disclaimer, the term of this patent is extended or adjusted under 35 U.S.C. 154(b) by 660 days.

(21) Appl. No.: 13/341,211

(22) Filed: Dec. 30, 2011

(65) Prior Publication Data

US 2013/0170887 A1 Jul. 4, 2013

(51) Int. Cl.

| | |
|---|---|
| ***B43K 8/12*** | (2006.01) |
| ***B43K 1/08*** | (2006.01) |
| ***B43K 5/18*** | (2006.01) |

(52) U.S. Cl.

CPC . *B43K 8/12* (2013.01); *B43K 1/086* (2013.01); *B43K 5/1845* (2013.01)

(58) Field of Classification Search

CPC ... B43K 5/1827; B43K 5/1836; B43K 5/1845
USPC ..... 401/188 A, 206, 273; 251/322, 284
See application file for complete search history.

(56) References Cited

U.S. PATENT DOCUMENTS

| | | | | |
|---|---|---|---|---|
| 2,320,823 | A * | 6/1943 | Kingson | 401/206 |
| 2,996,750 | A * | 8/1961 | Cholet | 401/206 |
| 4,195,941 | A * | 4/1980 | Barlow | 401/216 |
| 5,676,481 | A * | 10/1997 | Nicoll et al. | 401/206 |
| 6,817,802 | B2 | 11/2004 | Nishitani et al. | |
| 2003/0099501 | A1 | 5/2003 | Fukushima et al. | |
| 2007/0201940 | A1 | 8/2007 | Ziniti et al. | |
| 2009/0103968 | A1 | 4/2009 | Ballot | |

FOREIGN PATENT DOCUMENTS

WO WO-2011/008266 A1 1/2011

OTHER PUBLICATIONS

International Search Report and Written Opinion for corresponding international application No. PCT/US2012/070965, mailing date Mar. 27, 2013.

International Preliminary Report on Patentability for International Application No. PCT/US2012070965, dated Jul. 1, 2014.

* cited by examiner

*Primary Examiner* — David Walczak
*Assistant Examiner* — Bradley Oliver
(74) *Attorney, Agent, or Firm* — Marshall, Gerstein & Borun LLP

(57) ABSTRACT

A micro motion poppet valve for a writing instrument provides delivery of ink with large pigment particles to a porous writing nib with minimal nib movement and relatively light actuation forces. The micro motion poppet valve includes a nib connected to a valve stem, the valve stem being connected to a valve plug. A valve body is integrally formed with a biasing element, which biases the valve stem towards a closed position. When a user presses the nib against a writing surface the valve plug moves away from a raised valve seat located on the biasing element to allow ink to flow from an ink reservoir to the nib.

20 Claims, 4 Drawing Sheets

MICRO MOTION POPPET VALVE ASSEMBLY FOR DELIVERY OF INK WITH LARGE PIGMENT PARTICLES TO A WRITING NIB AND WRITING INSTRUMENT COMPRISING SAME

BACKGROUND

1. Field of the Disclosure

The disclosure generally relates to valve actuated writing instruments including ink compositions having large pigment particles and more particularly to poppet valves for such writing instruments.

2. Related Technology

Known writing instruments generally include an instrument body or shell, an ink reservoir containing an ink composition within the instrument body, and a writing tip or nib in fluid communication with the ink reservoir to deliver the ink composition to a substrate. Some writing instruments, such as ball point pens, contain relatively non-volatile, high viscosity inks. The ink compositions of these writing instruments generally contain relatively small pigment particles to avoid clogging the ball point or other delivery system. As a result, these writing instruments are generally limited in the type of ink that can be delivered to a substrate. On the other hand, such writing instruments containing viscous, non-volatile inks have little need for sealing mechanisms because there is little danger that the ink will evaporate under normal conditions.

Writing instruments such as capillary-action markers typically contain more volatile and less viscous inks. Conventional capillary-action markers contain a fibrous ink reservoir and a fibrous nib in fluid communication therewith. Such markers typically include an ink composition having a relatively low viscosity because the adhesive forces (between the ink composition and the channel walls of the reservoir and/or nib) must exceed the cohesive forces of the ink composition to permit movement of the composition by capillary action. Incorporating pigment particles such as aluminum flakes into the low viscosity ink compositions of a capillary-action marker is difficult because such pigment particles tend to settle out and agglomerate within the reservoir, nib, or both, rendering the marker inoperable. Even when the pigment particles are adequately suspended in the ink compositions, the marker's delivery system (e.g., the fibrous ink reservoir and the fibrous nib) typically undesirably becomes clogged over time. Thus, the pigment particle size in such systems is limited.

More recently, valve-action markers containing relatively large pigment particles have been developed. Typically, such valve-action markers utilize a spring-loaded nib, which opens a valve to an ink reservoir when depressed in the axial direction (e.g., against a writing surface), thereby allowing the ink to flow from the ink reservoir to the nib. Such valve-action markers are problematic, however, in that the pigment particles tend to settle to the bottom of the ink reservoir when the valve-action markers are not in use. Therefore, a consumer typically has to violently shake the marker prior to using same in order to effect distribution of the pigment particles throughout the ink composition and ensure that the ink composition delivered to the marker nib contains sufficient amounts of pigment particles to produce the desired visual effect. However, the consumer typically has no means to verify that the pigment particles material has been adequately distributed throughout the ink composition because the marker barrel or shell is opaque. The user must also subsequently depress the nib against a writing surface with significant force to open the valve to the ink reservoir and continue to apply significant force on the nib in order to allow delivery of the ink composition to the nib when writing. The valve of such systems typically must be moved substantially, typically 0.1 inches or more, in an axial direction before ink will begin to flow. This large axial movement must be repeated and maintained whenever ink is delivered and is therefore generally undesirable from the standpoint of consumers. In fact, such a large valve displacement requires a relatively heavy force that can significantly exceed the forces generated during normal writing. Thus, known valve systems require a consumer to use an unnatural writing stroke which can be fatiguing.

SUMMARY

A micro motion poppet valve assembly for a writing instrument includes a writing nib, a valve body coupled to a biasing element, a valve stem partially disposed within the valve body, and a valve plug coupled to the valve stem. The writing nib is coupled to the valve stem, and the writing nib and the valve stem are longitudinally movable with respect to the valve body and the biasing element. The biasing element includes a body and a cone-shaped portion, the cone-shaped portion is deformable along a longitudinal axis, and the cone-shaped portion biases the valve stem to a closed position.

A writing instrument for use with inks comprising large pigment particles includes an instrument body and an ink reservoir disposed within the instrument body. A valve assembly is disposed within the instrument body, the valve assembly including a writing nib; a valve body coupled to a biasing element, a valve stem partially disposed within the valve body, and a valve plug coupled to the valve stem. The nib is coupled to the valve stem, and the nib and valve stem are longitudinally movable with respect to the valve body and biasing element. The biasing element includes a body and a cone-shaped portion, the cone-shaped portion being deformable along a longitudinal axis, and the cone-shaped portion biasing the valve stem to a closed position.

BRIEF DESCRIPTION OF THE DRAWINGS

Exemplary aspects and features of an instrument constructed in accordance with the disclosure are described and explained in greater detail below with the aid of the drawing figures in which.

DETAILED DESCRIPTION

A micro motion poppet valve for a writing instrument provides delivery of ink with large pigment particles by a porous extruded plastic writing nib with minimal nib movement and relatively light actuation forces. The micro motion poppet valve includes a porous extruded plastic writing nib coupled to a valve stem, the valve stem being coupled to a valve plug. The valve stem is partially disposed within a valve body, the valve body being coupled to a biasing element, which biases the valve stem towards a closed position. When a user presses the nib against a writing surface, the valve plug moves away from the valve body to allow ink to flow from an ink reservoir to the nib.

The disclosed micro motion poppet valve assembly and writing instrument are particularly useful in delivering ink having large pigment particles, such as brass pigments and correction fluids. By avoiding the use of capillary channels typically associated with the markers preferred by consumers, the disclosed micro motion poppet valve is able to maintain such large pigment particles in suspension and prevent agglomeration of the particles whereas such pigment particles often clog the capillary channels of conventional markers and thereby often cause conventional markers containing such inks to fail.

A writing instrument incorporating the micro motion poppet valve assembly has ability to deliver ink compositions containing relatively large pigment particles, for example, pigment particles having a diameter greater than about 15 microns, greater than 20 microns, greater than 25 microns, greater than 30 microns, and/or greater than 40 microns without having to depress and continue to depress the nib with significant force when writing with the writing instrument. Moreover, the disclosed writing instrument need not include a capillary/fibrous ink reservoir or fibrous nib and can therefore be much less susceptible to clogging than other writing instruments including relatively large pigment particles. Furthermore, the disclosed writing instrument can utilize relatively high viscosity inks which can minimize pigment particle settling and obviate the need to mechanically agitate the system so as to uniformly distribute the pigment particles throughout the ink composition.

The disclosed micro motion valve assembly may actuated by very small (approximately 0.01 inches or approximately 0.254 mm) axial movements of a writing nib and require very little pressure to activate the valve, which is desirable from a consumer perspective. In one embodiment a mass of between approximately 75 grams and approximately 150 grams (i.e., between one and two ounces) is sufficient to activate the valve from the closed position to the open position. Such small masses enable the valve to be actuated during the normal course of writing, rather than forcing a user to stop and purposefully actuate the valve, and continue to apply such pressure to continue to write, as in prior art valve actuated writing systems.

Figure 1:
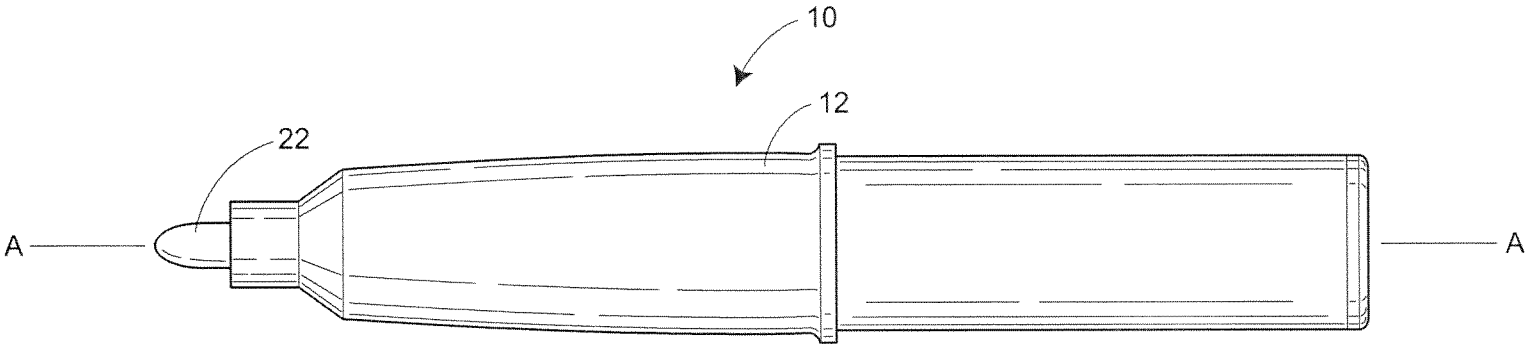
FIG. 1 is a longitudinal view of a micro motion poppet valve assembly constructed in accordance with the disclosure.

Turning now to FIG. 1, a micro motion valve assembly 10 according to the invention generally includes a barrel portion 12. The barrel portion 12 may be connected to a shell of a writing instrument that contains an ink reservoir in fluid communication with the micro motion valve assembly 10. A nib 22 extends outward from one end of the barrel portion 12. The valve assembly 10 selectively permits or restricts ink flow from the ink reservoir to the nib 22. When pressure is applied to the nib 22 by a user contacting the nib 22 with a substrate, the nib 22 is moved along a longitudinal axis A of the barrel portion 12 towards the ink reservoir, and the valve assembly 10 opens to permit ink to flow to the nib 22.

Figure 2:
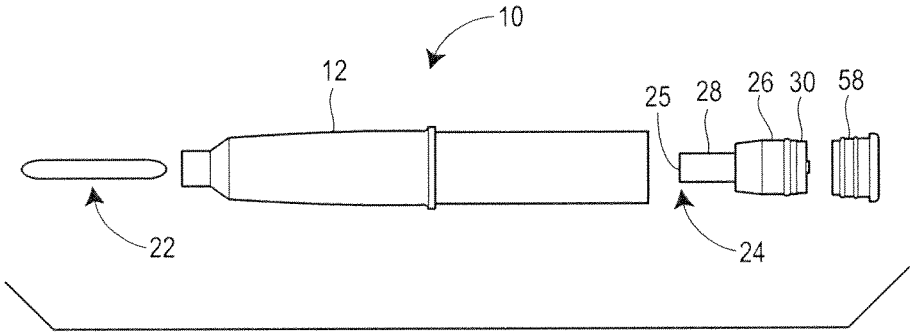
FIG. 2 is an exploded longitudinal view of the micro motion poppet valve assembly of FIG. 1.

FIG. 2 illustrates the nib 22 in an exploded view of the valve assembly 10. The nib 22 is housed in a nib holder 24, which is formed at one end of a valve stem 28. The nib 22 is mounted within an opening in a first end 25 of the nib holder 24. The valve assembly 10 includes the barrel portion 12, the valve stem 28, a valve body 26, a valve biasing element 30, and a valve plug 58. When the nib 22 moves towards the biasing element 30 (and hence towards the ink reservoir), the valve stem 28 also moves towards biasing element 30 (and hence towards the ink reservoir), opening the valve assembly 10, allowing ink to flow from the ink reservoir to the nib 22.

Figure 3:
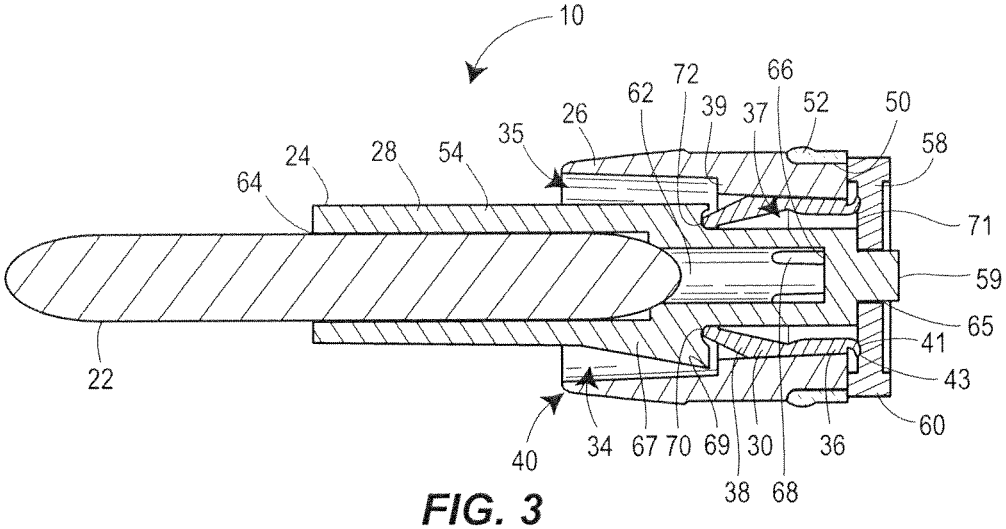
FIG. 3 is a longitudinal cross-sectional view of the micro motion poppet valve assembly of FIG. 2 in a closed position.

Turning now to FIG. 3, the valve body 26 includes a central bore 34 having a generally funnel-shaped first portion 35 that is separated from a generally funnel-shaped second portion 37 by a shoulder 39. The second portion 37 of the central bore 34 receives the biasing element 30, which in the illustrated embodiment comprises a resilient spring. The valve body 26 includes a conical front portion 40 that seats within a front end of the barrel portion 12. The valve body 26 may also include an annular recess 50 sized to receive a seal 52, such as an o-ring, to seal the valve body 26 against an inner surface of the barrel portion 12. In other embodiments, the valve body 26 may be integrally formed with or even provided by the barrel portion 12, or an instrument body or shell.

The seal 52 may be formed integrally with the biasing element 30 during a single shot in an injection molding process. The valve body 26 and the biasing element 30 may be integrally formed during two separate shots of a two-shot injection molding process. More specifically, the valve body 26 may be formed of a thermoplastic material during a first shot, while the biasing element 30 and the seal 52 may be formed from a thermoplastic elastomer (TPE) during a second shot. As a result, the valve body 26, the biasing element 30, and the seal 52 can be integrally formed, while advantageously retaining two different sets of material properties for the respective components 26, 30, 52, to facilitate assembly of the micro-motion poppet valve assembly.

Thermoplastic materials that may be used for the valve body 26 include but are not limited to various thermoplastics such as polyethylene, HDPE, Nylon, polyvinylchloride (PVC), and blends thereof. Specific exemplary thermoplastic materials include but are not limited to Model No. P4C6Z-022 and Model No. P4C6B-024B, both made by Huntsman International (Woodlands, Tex.), Model No. HM35Z2 made by Arco Chemical Company (Newtown Square, Pa.), and Marlex HLN-350 made by Phillips Sumika Polypropylene Company (Woodlands, Tex.).

TPEs that may be used for the biasing element 30 and the seal 52 should have a stiffness in the range of between approximately 20 durometer and approximately 80 durometer, preferably in the range of between approximately 30 durometer and approximately 65 durometer, and more preferably in the range of between approximately 35 durometer and approximately 45 durometer. Stiffnesses in these ranges provide adequate biasing force while preventing problems encountered with stiffer materials, such as compression set. Specific exemplary TPE's include but are not limited to Model No. LC290-105 made by GLS Corp. (McHenry, Ill.), Dynaflex G2780-0001 and Dynaflex G7980-1001-00, also made by GLS Corp., Santoprene 101-73, Santoprene 101-80, Santoprene 101-87, Santoprene 8201-70, Santoprene 8201-80, Santoprene 8201-90, and Santoprene 8211-75, made by Advanced Elastomer Systems, L.P. (Akron, Ohio), and Monprene MP-2890M, Monprene MP-2870, Monprene MP-1894, and Monprene MP-2780, made by Teknor Apex Company (Pawtucket, R.I.).

The biasing element 30 includes a generally cylindrical body portion 36 and a cone-shaped portion 38. The cone-shaped portion 38 is generally disposed within the second portion 37 of the central bore 34 when the biasing element 30 is inserted into the valve body 26. The cone-shaped portion 38 is axially flexible longitudinally within the central bore 34, as will be discussed further hereinafter. At one end, opposite the cone-shaped portion 38, the biasing element has a raised valve seat 41. The raised valve seat 41 in this embodiment takes the form of a cantilevered ledge 43. The cantilevered ledge 43 is flexible and forms a liquid tight seal with the valve plug 58 when the valve assembly 10 is in a closed position.

As illustrated, the valve stem 28 includes a stem body 54 that is connected to the valve plug 58 at one end with a cylindrical connector 59 that fits within an opening 65 of the valve plug 58. The stem body 54 also includes one or more angled ribs 67 distributed about a periphery of the stem body 54. The angled ribs 67 extend outward from a periphery of the stem body 54 and axially along the stem body 54, terminating in a flat end 69. The flat end 69 cooperates with the shoulder 39 in the valve body 26 to limit axial movement (which would be otherwise introduced by application of normal forces used during writing) of the stem body 54 with respect to the valve body 26. In other words, the flat end 69 and the shoulder 39 cooperate to form a stop that limits longitudinal movement of the valve stem body 54 (and thus the nib 22) in an aft direction, towards the ink reservoir. By carefully setting the distance between the flat end 69 and the shoulder 39, longitudinal travel of the nib 22 can be controlled and set to an amount that is barely (if at all) perceptible to a user when writing. In this way, a user will activate the valve assembly 10 during the normal course of writing without disturbing the user's natural writing stroke. When the valve assembly 10 is in a closed position, a particularly useful distance between the flat end 69 and the shoulder 39 may be in the range of approximately 0.02 in (0.0508 cm) to approximately 0.005 in (0.0127 cm), more preferably in the range of approximately 0.015 in (0.0381 cm) to approximately 0.008 in (0.02032 cm), and even more preferably in the range of approximately 0.012 in (0.03048 cm) to approximately 0.008 in (0.02032 cm). These ranges provide adequate clearance for the large pigment particles to flow through while remaining nearly imperceptible to a user of the writing instrument.

In the closed position, a first surface 71 of the valve plug 58 seats against the cantilevered ledge 43 to restrict ink flow through the valve assembly 10. The valve plug 58 may be generally cylindrical in shape including an outer annular flange 60 formed about a periphery of the valve plug 58. The outer annular flange 60 cooperates with one end of the valve body 26 to provide a secondary seal for an ink flow channel that is formed between the valve plug 58 and the valve body 26 and the cantilevered flange 43 upon application of normal pressure during writing. The ink flow channel continues between the valve stem 28 and the biasing element 30, through one or more openings or slots 68 located in the valve stem body 54 and into a longitudinal bore 62 in the valve stem body 54 that is open at a first end 64 and closed at a second end 66. Slots 68 may be preferred for their ability to pass relatively large pigment particles without becoming clogged. In other embodiments, other shapes or sizes of openings may be used that are appropriate to pass the pigment particles disposed in the ink being used by the writing instrument. The longitudinal bore 62 continues the ink flow path through the valve stem body 54 to the nib 22. Ink flows into the longitudinal bore 62 through the plurality of openings or slots 68, proximate the second, closed end 66 of the longitudinal bore 62, when the valve assembly 10 is open (see FIG. 4). The valve stem body 54 also includes an annular channel 70 located between the first end 64 and the second end 66 of the stem body 54. The annular channel 70 is located proximate the flat end 69 of the angled rib 67 in this embodiment. In other embodiments, the annular channel 70 may be located closer to the second end 66 of the stem body 54. The annular channel 70 receives an open end 72 of the cone-shaped portion 38 of the biasing element 30, at least a portion of the valve stem body 54 being located within the cone-shaped portion 38 of the biasing element 30.

FIG. 3 illustrates the valve assembly 10 in a closed position, preventing ink flow from the ink reservoir to the writing nib 22. In the closed position, one side of the valve plug 58 contacts the seat 41 on the biasing element 30. The valve plug 58 and the seat 41 form a seal that prevents ink from flowing into the longitudinal bore 62. In the absence of writing pressure, the cone-shaped portion 38 of the biasing element 30 biases the valve stem 28 forward, towards a closed position. Thus, the valve stem 28 and nib 18 are longitudinally movable within the barrel portion 12, while the valve body 26 and biasing element 30 remain fixed with respect to the barrel portion 12.

Figure 4:
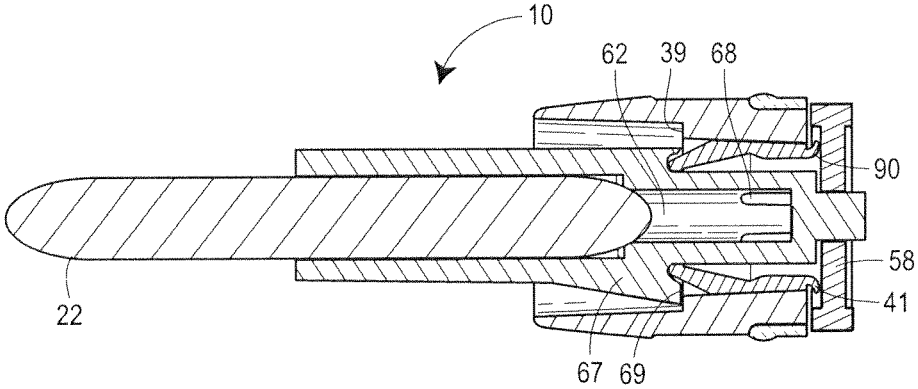
FIG. 4 is a longitudinal cross-sectional view of the micro motion poppet valve assembly of FIG. 2 in an open position.

As discussed above, in the closed position, illustrated in FIG. 3, the flat end 69 of angled rib 67 is spaced from the shoulder 39 by between approximately 0.005 inches (0.127 mm) and approximately 0.02 inches (0.508 mm), preferably between approximately 0.005 inches (0.127 mm) and approximately 0.015 inches (0.381 mm), and more preferably between approximately 0.008 inches (0.2032 mm) and approximately 0.012 inches (0.3048 mm). This spacing imparts a gap 90 of a similar size between the valve plug 58 and the raised valve seat 41 when the valve assembly 10 is actuated by a user to an open position, as illustrated in FIG. 4. In particular, the gap 90 may be sized to between approximately 0.005 inches (0.127 mm) and approximately 0.02 inches (0.508 mm), preferably between approximately 0.005 inches (0.127 mm) and approximately 0.015 inches (0.381 mm), and more preferably between approximately 0.008 inches (0.2032 mm) and approximately 0.012 inches (0.3048 mm).

FIG. 4 illustrates the valve assembly 16 in an open position. When the nib 22 is displaced aft, towards the biasing element 30 (and hence towards the ink reservoir), the nib 22 and the valve stem 26 move aft until the flat end 69 of the angled rib 67 contacts the shoulder 39. As the nib 18 moves aft, the valve stem 28 also moves aft, which causes the valve plug 58 to disengage from the valve seat 41. As the valve plug 58 disengages from the valve seat 41, ink begins to flow from the ink reservoir, through the gap 90 created between the valve plug 58 and the valve seat 41 and into the longitudinal bore 62 through the openings/slots 68. Ink continues to flow under gravity or capillary action through the longitudinal bore 62 and to the nib 22.

Figure 5:
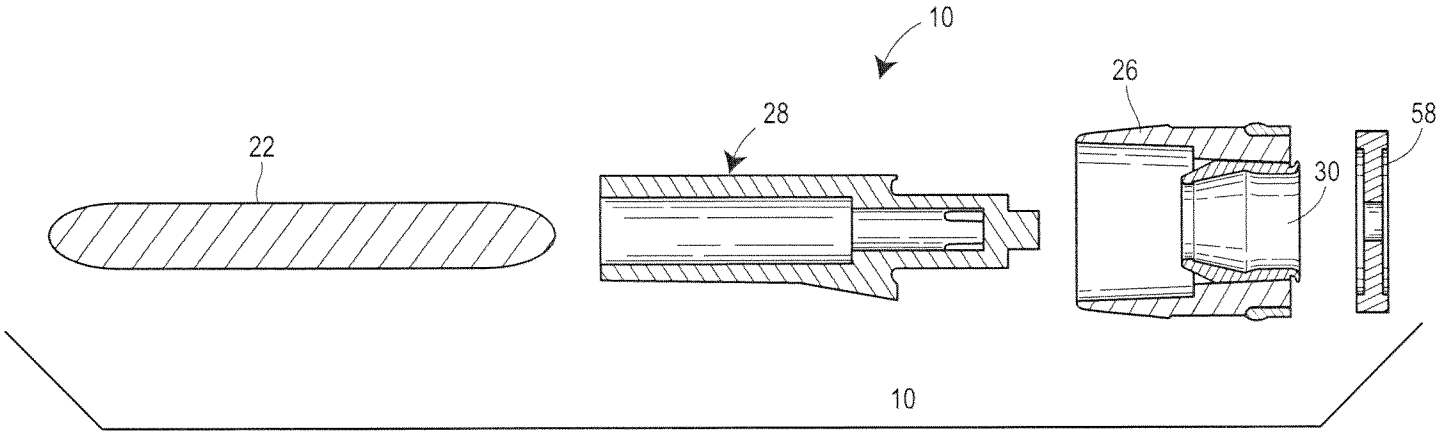
FIG. 5 is an exploded cross-sectional view of the micro motion poppet valve assembly of FIG. 2.
Figure 6:
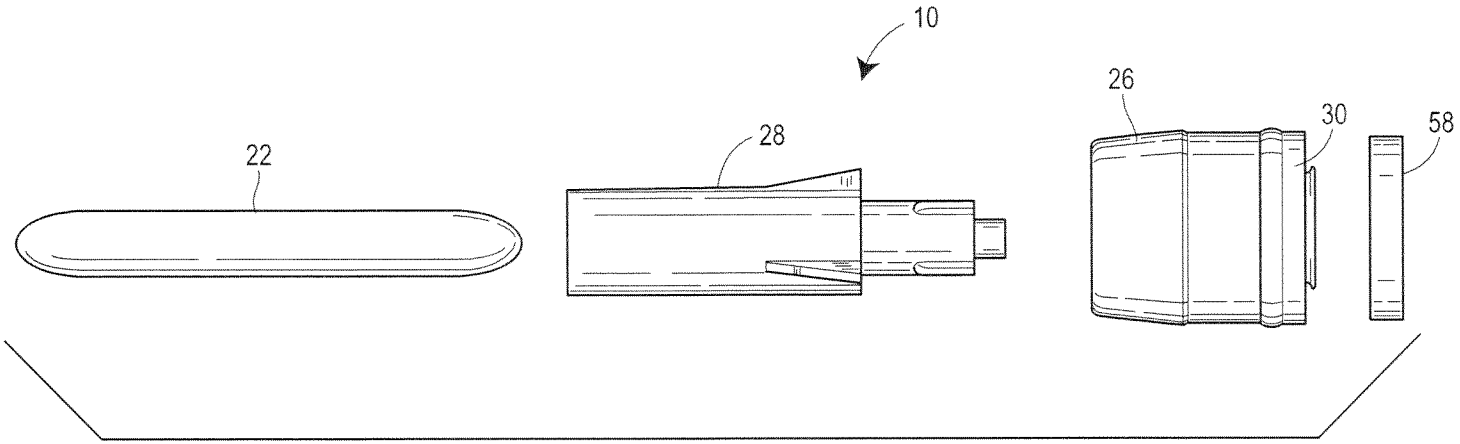
FIG. 6 is an exploded longitudinal view of the micro motion poppet valve assembly of FIG. 2.

FIGS. 5 and 6 illustrate the major components of the valve assembly 10 in an assembly order. More particularly, the nib 22 may be inserted into the valve stem 28. The valve stem 28 may be inserted into the combination valve body 26/biasing element 30. Finally, the valve plug 58 may be attached to the valve stem 28. By forming the valve body 26 and the biasing element 30 in a two-shot injection molding process, assembly time for the valve assembly 10 is reduced and part inventory is decreased.

Figure 7:
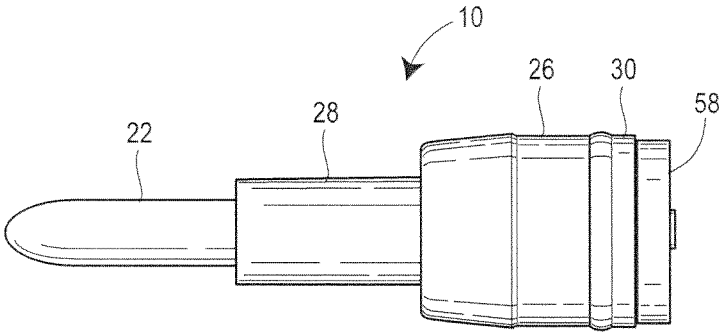
FIG. 7 is a longitudinal view of the micro motion poppet valve assembly of FIG. 2.

FIG. 7 illustrates the valve assembly 10 in a fully assembled condition.

Figure 8:
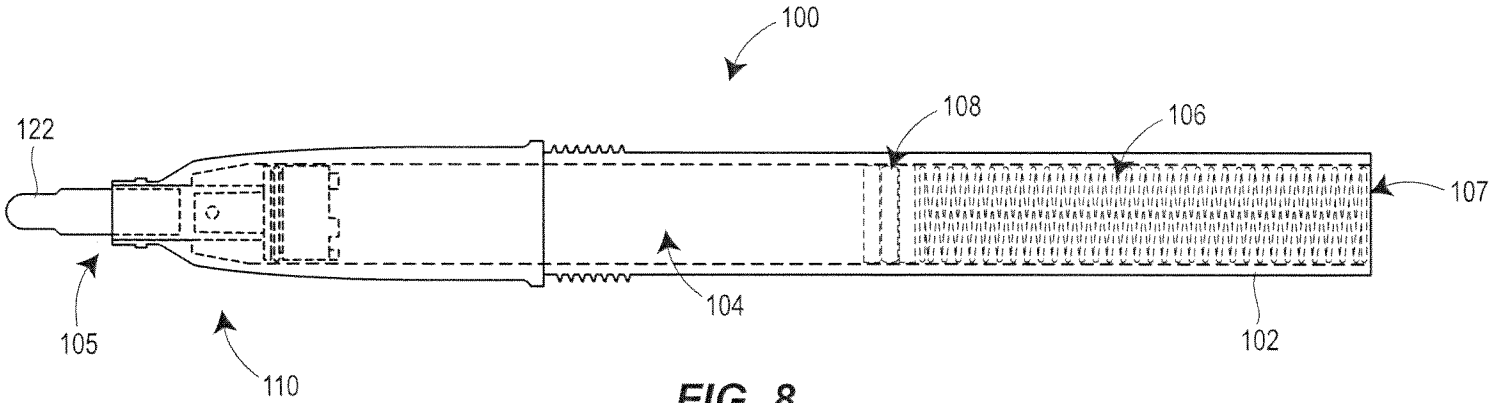
FIG. 8 is a longitudinal view of a writing instrument including the micro motion poppet valve assembly of FIG. 1.

FIG. 8 illustrates one embodiment of a writing instrument 100 that includes a micro motion poppet valve assembly 110, as described above. The writing instrument includes an instrument body 102 and a micro motion poppet valve assembly 110 disposed at a first end 105 of the instrument body 102. An ink reservoir 104 is disposed within the instrument body for supplying ink a writing nib 122. As illustrated, a pressurizing element 106 is disposed between the ink reservoir 104 and a second end 107 of the instrument body 102, but the pressurizing element 106 is merely an optional component.

The pressurizing element 106, which is illustrated as a spring, may be located within the instrument body 102, opposite the nib 122 and between an end plug (not shown) of the writing instrument 100 and the ink reservoir 104. The spring 106 applies pressure to the ink reservoir 104 in order to pressurize ink within the ink reservoir 104. Of course, a pressurized gas could be used as a pressurizing element 106 instead of spring. A plug 108 separates the pressurizing element 106 from the ink reservoir 104. The plug 108 forms a seat that allows the pressurizing element 106 to impart a pressurizing force to the ink reservoir 104, thereby pressurizing ink within the ink reservoir 104.

The nib 122 is fluidly connected to the ink reservoir 106 by an ink channel. The ink channel begins at the ink reservoir 106, which is fluidly connected to the gap 90 (FIG. 4) formed between the valve plug 58 and the raised valve seat 41 located on the biasing element 30. The ink channel continues between an outer surface of the valve stem body 54 and an inner surface of the biasing element 30 (FIG. 3). The ink channel transitions into the longitudinal bore 62 through the openings 68. The ink channel continues within the longitudinal bore 62 until reaching the nib 22. The ink channel fluidly connects the nib 22, the longitudinal bore 62, the inner surface of the biasing element 30, the gap 90, and the ink reservoir 106 to one another.

As discussed above, the ink used in the disclosed micro motion poppet valve assembly can include relatively large particle pigments. Some inks may also be shear-thinning, i.e., non-Newtonian liquids that exhibit shear-thinning flow behavior when subjected to shear. Some shear-thinning inks become thin, readily flowable liquids having a viscosity of no greater than about 1000 mPa·sec at shear rates greater than about 100 $sec^{-1}$. Exemplary shear thinning inks may have a shear thinning index of between approximately 0.01 and approximately 0.8.

To enhance the shear thinning characteristics of some inks, the pressurized ink reservoir provides shearing energy to the ink as the ink flows through the micro motion poppet valve. In one embodiment, the ink reservoir is pressurized to between approximately 1 pound per square inch (psi) (approximately 6.89 kPa) and approximately 20 psi (approximately 137.9 kPa), between approximately 2 psi (approximately 13.79 kPa) and approximately 10 psi (approximately 68.95 kPa), and/or between approximately 2 psi (approximately (13.79 kPa) and approximately 5 psi (approximately 34.47 kPa).

Although certain writing instruments and poppet valve assemblies have been described herein in accordance with the teachings of the present disclosure, the scope of coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. Accordingly, it is the intention to protect all variations and modifications that may occur to one of ordinary skill in the art.

What is claimed is:

1. A micro motion poppet valve assembly for a writing instrument, the poppet valve assembly comprising:

a writing nib;

a valve body coupled to a biasing element, a shoulder within a central bore of the valve body, a valve stem partially disposed within the valve body, an angled rib extending outwardly from a periphery of the valve stem and axially along the valve stem, and a valve plug coupled to the valve stem, wherein the writing nib is coupled to the valve stem, the writing nib and the valve stem being longitudinally movable with respect to the valve body and the biasing element, and wherein the biasing element includes a body and a cone-shaped portion, the cone-shaped portion being deformable along a longitudinal axis, and the cone-shaped portion biasing the valve stem to a closed position.

2. The micro motion poppet valve assembly of claim 1, wherein the valve stem further comprises a longitudinal bore and a plurality of openings in the stem, the plurality of openings providing fluid communication between the longitudinal bore and an ink reservoir.

3. The micro motion poppet valve assembly of claim 1, wherein the valve stem includes an annular channel disposed in an outer surface thereof.

4. The micro motion poppet valve assembly of claim 3, wherein an open end of the cone-shaped portion is received in the annular channel.

5. The micro motion poppet valve assembly of claim 1, wherein the biasing element biases the valve stem towards the nib.

6. The micro motion poppet valve assembly of claim 1, wherein the cone-shaped portion of the biasing element being disposed in the central bore.

7. The micro motion poppet valve assembly of claim 1, wherein the valve body and the biasing element are integral with one another and formed in a two-shot injection molding process.

8. The micro motion poppet valve assembly of claim 1 wherein the valve body is formed from a thermoplastic material during a first shot and the biasing element is formed from a TPE material during a second shot.

9. The micro motion poppet valve assembly of claim 1, wherein the valve plug includes an annular flange that seats against the valve body.

10. The micro motion poppet valve assembly of claim 1, wherein the biasing element includes a raised valve seat that cooperates with the valve plug to selectively permit or restrict ink flow through the valve assembly.

11. The micro motion poppet valve assembly of claim 10, wherein the raised valve seat includes a cantilever ledge.

12. The micro motion poppet valve assembly of claim 1, wherein the valve body includes a cone-shaped front portion.

13. The micro motion poppet valve assembly of claim 1, wherein the valve body includes an annular channel on an outer surface thereof that is sized to receive an annular seal.

14. The micro-motion poppet valve assembly of claim 13, further comprising an annular seal disposed in the annular channel.

15. The micro-motion poppet valve assembly of claim 1, wherein the angled rib includes a flat end.

16. The micro-motion poppet valve assembly of claim 15, wherein the flat end is separated from the shoulder by a distance of between approximately 0.02 in and approximately 0.005 in.

17. The micro-motion poppet valve assembly of claim 1, wherein the writing nib is a porous plastic nib.

18. A writing instrument for use with inks comprising large pigment particles, the writing instrument comprising:

an instrument body;

an ink reservoir disposed within the instrument body;

a valve assembly disposed within the instrument body, the valve assembly including a writing nib; a valve body coupled to a biasing element, a shoulder formed within a central bore of the valve body, a valve stem partially disposed within the valve body, an angled rib extending outwardly from a periphery of the valve stem and axially along the valve stem, and a valve plug coupled to the valve stem, wherein the writing nib is coupled to the valve stem, the writing nib and valve stem being longitudinally movable with respect to the valve body and biasing element, wherein the biasing element includes a body and a cone-shaped portion, the cone-shaped portion being deformable along a longitudinal axis, and the cone-shaped portion biasing the valve stem to a closed position, and wherein an ink channel fluidly connects the ink reservoir, the valve plug, the biasing element, the valve stem, and the writing nib for delivery of ink from the ink reservoir to the writing nib.

19. The writing instrument of claim 18, further comprising a pressurizing element disposed in the instrument body, the pressurizing element imparting a pressurizing force to the ink reservoir.

20. A micro-motion poppet valve assembly for a writing instrument, the poppet valve assembly comprising:

a writing nib;

a valve body coupled to a biasing element, a valve stem partially disposed within the valve body, a valve plug coupled to the valve stem, an annular channel on an outer surface of the valve body that is sized to receive an annular seal, and an annular seal disposed in the annular channel, wherein the writing nib is coupled to the valve stem, the writing nib and the valve stem being longitudinally movable with respect to the valve body and the biasing element, wherein the biasing element includes a body and a cone-shaped portion, the cone-shaped portion being deformable along a longitudinal axis, wherein the cone-shaped portion biases the valve stem to a closed position, and wherein the annular seal is integrally formed with the biasing element.

* * * * *